US006782896B1

(12) United States Patent
Grimes

(10) Patent No.: US 6,782,896 B1
(45) Date of Patent: Aug. 31, 2004

(54) HAIR LACING TOOL FOR DECORATIVE INSERTS

(76) Inventor: Gary E. Grimes, R.D. #1, Box 450, New Cumberland, WV (US) 26047

( * ) Notice: Subject to any disclaimer, the term of this patent is extended or adjusted under 35 U.S.C. 154(b) by 0 days.

(21) Appl. No.: 10/283,809

(22) Filed: Oct. 31, 2002

(51) Int. Cl.[7] ..... A45D 7/02; A45D 24/00; A45D 8/04

(52) U.S. Cl. ..... 132/212; 132/200; 132/273

(58) Field of Search ..... 132/212, 200, 132/273, 275, 321; 223/99, 102, 103

(56) References Cited

U.S. PATENT DOCUMENTS 2,777,622 A * 1/1957 Fehlmann ..... 132/103
2,891,547 A * 6/1959 Stradella ..... 223/102
4,168,792 A * 9/1979 Morin ..... 223/102
4,296,877 A * 10/1981 Lubow ..... 223/99
5,036,870 A 8/1991 Edmark
5,657,776 A 8/1997 Espenschied
5,806,538 A 9/1998 Keltner
5,832,938 A 11/1998 Ybarra

* cited by examiner

*Primary Examiner*—John J Wilson
*Assistant Examiner*—Robyn Kieu Doan
(74) *Attorney, Agent, or Firm*—Harpman & Harpman

(57) ABSTRACT

A method and apparatus for inserting a decorative ribbon into braided human hair. The apparatus is of a needle configuration having an elongated shaft pointed at one end and a ribbon-retaining eyelet at the opposite end. The eyelet has a progressive engagement and retaining insert to selectively engage and hold a ribbon within. A ribbon can therefore pass through the weaves of the braid in a variety of decorative repetitive patterns.

2 Claims, 5 Drawing Sheets

HAIR LACING TOOL FOR DECORATIVE INSERTS

BACKGROUND OF THE INVENTION

1. Technical Field

This invention relates to the field of hair styling specifically devices to insert fabric into hairbraids in a decorative pattern. Such devices are used to pull and weave material through human hair.

2. Description of Prior Art

Prior art devices of this type have been divided into styling tools that hold and separate portions of human hair to allow for direct manipulation and needle type inserts, see for example U.S. Pat. Nos. 5,036,870, 5,657,776, 5,806,538 and 5,832,938.

In U.S. Pat. No. 5,036,870 a hair styling tool can be seen having an elongated probe with an elastic loop extending there from.

U.S. Pat. No. 5,657,776 claims a hair stitching shaft for decorating hair in which an elongated shaft having a pointed end and an opposing end eyelet is disclosed. A scarf is threaded through the eyelet having a diamond shape cutout with equal lateral narrowing points into which the scarf is wedgeably disposed.

U.S. Pat. No. 5,806,538 shows a hair styling tool having a U-shaped hook and arm extending from the distal end of a contoured handle.

U.S. Pat. No. 5,832,938 described a hair styling method for weaving strands of one ponytail through the hair foundation using a weaving tool having a hollow needle with a reciprocating sleeve. A noose extends from the needle's proximal end.

SUMMARY OF THE INVENTION

A hair weaving method and apparatus for pulling decorative ribbon material through a braid of human hair in a variety of repetitive patterns. The hair-weaving tool is of an elongated needle configuration having a ribbon engagement element integrally formed within an enlarged eyelet inwardly of its proximal end. A ribbon can be frictionally secured within without damage or distortion and pulled through incrementally spaced weave points within the braid to form a "woven" pattern of distinctive color and contrast in the hair.

DESCRIPTION OF THE DRAWINGS

FIG. 7 is a graphic representation of a hair braid with a ribbon being partially woven there through;

DESCRIPTION OF THE PREFERRED EMBODIMENT

Figure 1:
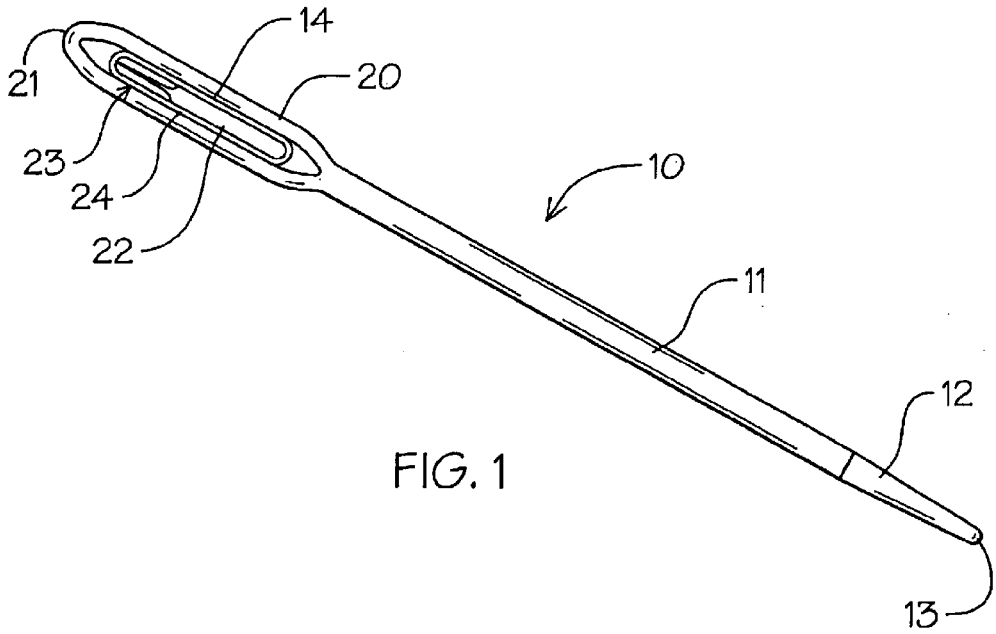
FIG. 1 is a perspective view of the lacing tool of the invention.
Figure 2:
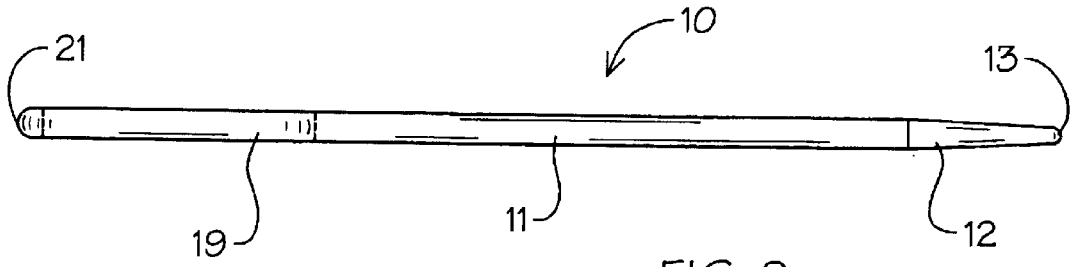
FIG. 2 is a side elevational view thereof.
Figure 3:
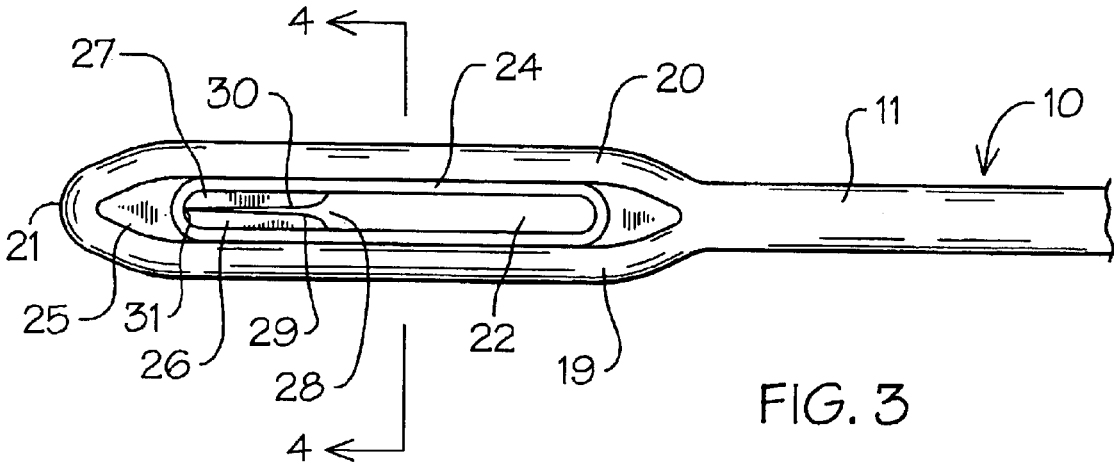
FIG. 3 is an enlarged top plan view of the ribbon engagement eyelet portion of the invention.
Figure 4:
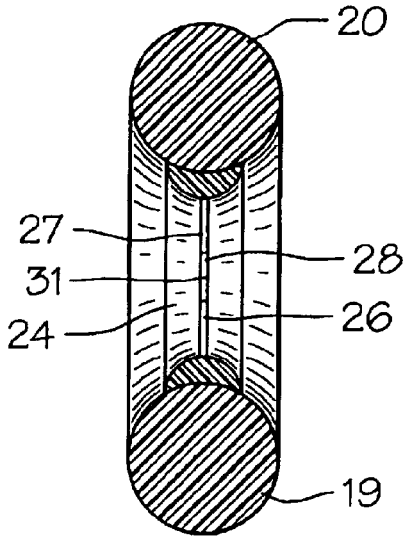
FIG. 4 is an enlarged cross-sectional view on lines 4—4 of FIG. 3 of the drawings.
Figure 5:
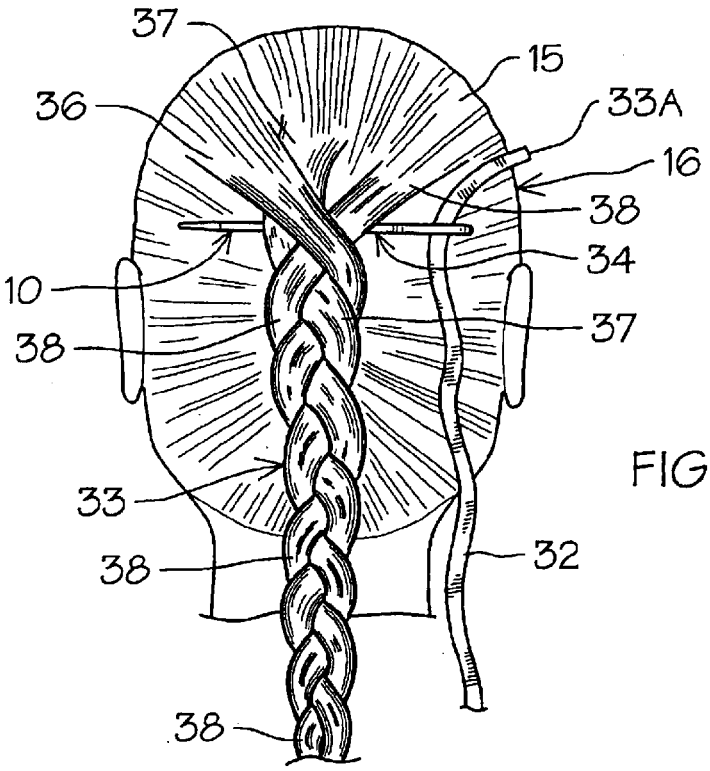
FIG. 5 is a graphic representation of the top and back portion of a human head with a hair braid and tool of the invention engaged there under.
Figure 6:
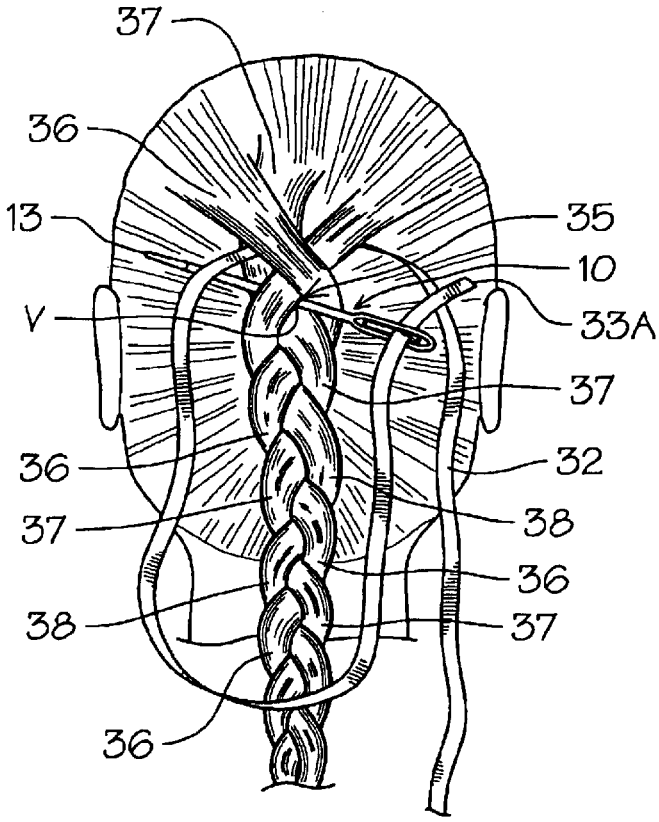
FIG. 6 is a graphic representation of a human head set forth in FIG. 5 illustrating a tool insert positioned through the hair braid.
Figure 7:
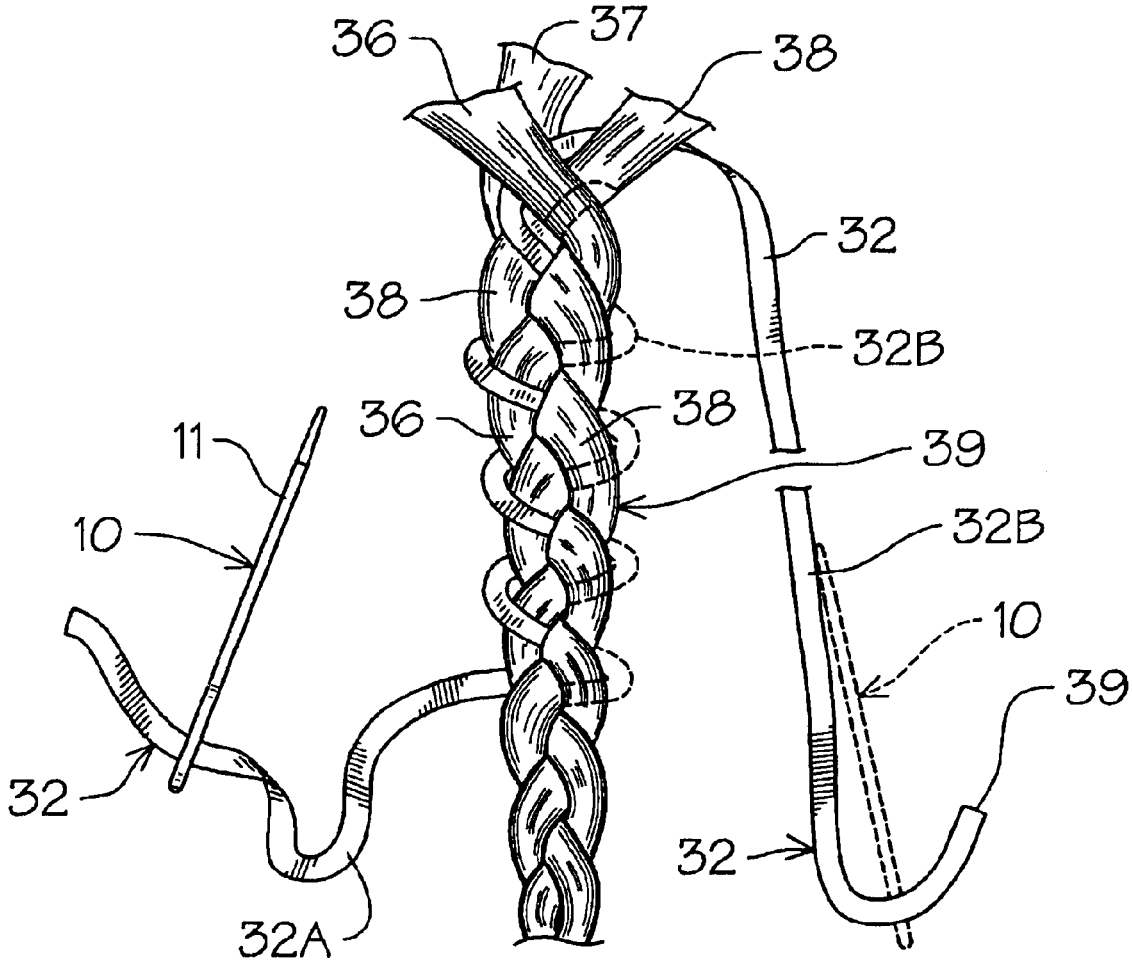

Referring now to FIG. 1 of the drawings, a lacing tool 10 can be seen having an elongated shaft body 11 with a conical end portion 12 defining a hair engagement point at 13 on its distal end. A ribbon engagement and registration eyelet 14 is positioned inwardly of its oppositely disposed proximal end. The engagement point 13 facilitates pushing the tool 10 through the hair 15 on a human head 16 as illustrated in FIG. 5 and 6 of the drawings. Referring to FIGS. 1, 3, and 4 of the drawings, the eyelet 14 of the lacing tool 10 can be seen having a pair of spaced parallel elongated body members 19 and 20 extending longitudinally from the elongated shaft body 11 to a termination point at 21 defining a material engagement opening at 22 there between. A material restraint fitting 23 is formed within the opening 22 extending from a continuous support bead 24 about the opening 22 as best seen in FIG. 3 of the drawings. A support web 25 is formed within the opening 22 between the respective body members 19 and 20 inwardly of the termination point 21. The restraint fitting 23 has a pair of oppositely disposed web elements 26 and 27 extending from the bead 24 adjacent the web 25. The web elements 26 and 27 define an intersecting V-shaped notch at 28. The support web 25 and web elements 26 and 27 are of a combined length equal to about one-third the overall longitudinal length of the opening 22 as hereinbefore described. The notch at 28 has a dimensional opening aspect of 0.015 of an inch at its widest point between oppositely disposed angular surfaces 29 and 30 of the respective web elements 26 and 27 to 0.005 of an inch adjacent its termination point at 31.

Figure 9:
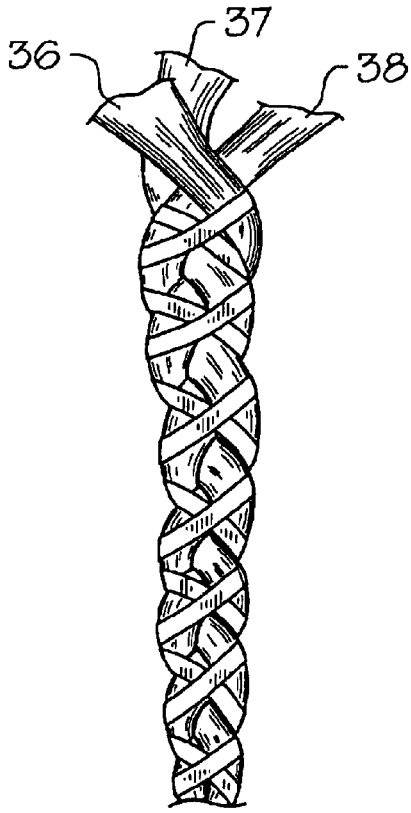
FIG. 9 illustrates a completed ribbon insertion pattern showing an x-pattern.

The defined dimensional aspects of the notch 28 is critical to the function of the device in which a fabric ribbon 32 is passed through and wedgeably engaged therein as generally illustrated in FIGS. 5, 6 and 9 of the drawings. It will therefore be evident that once the ribbon 32 is inserted through the engagement opening 22 it will be wedgeably secured within the tapered notch 28 at any point along its length allowing for any required adjustment thereto.

The lacing tool 10 of the invention is of a sufficient length to transect and extend beyond its insertion and exit points within the hair as will be explained in greater detail hereinafter.

Referring now to FIGS. 5–8 of the drawings, a basic hair weaving sequence is illustrated on a single braid 33 of hair on the head 16 as follows.

A length of the ribbon 32 to be used is determined by measuring the length of the braid 33 three times. The lacing tool 10 is then threaded with the ribbon 32 at a point that is approximately two inches inwardly of its end at 33A. The threaded lacing tool 10 is then passed under the top portion of the braid 33 at 34 from right to left as seen in FIG. 5 of the drawings to a point at which the ribbon 32 is of equal lengths 32A and 32B on either side of the braid 33. The lacing tool 10 is then inserted through the braid 33 repeatedly from right to left at 35, as seen in FIG. 6 of the drawings. The insertion sequence is repeated longitudinally down the length of the braid 33 inserting the tool at each of the braid's hair section intersections V formed by the braid's respective hair bands 36, 37 and 38 keeping the ribbon 32 flat and smooth in the process as illustrated best in FIG. 7 of the drawings.

The ribbon 32 is removed from the lacing tool 10 and inserted onto the remaining end at 39 of the ribbon 32 extending from the right side 39 of the braid 33. The lacing tool 10 is then inserted from the right at 40 each of the respective hair band intersections integrally weaving the ribbon 32 in repetitive fashion down the right side of the braid 33 as seen in broken lines.

Figure 8:
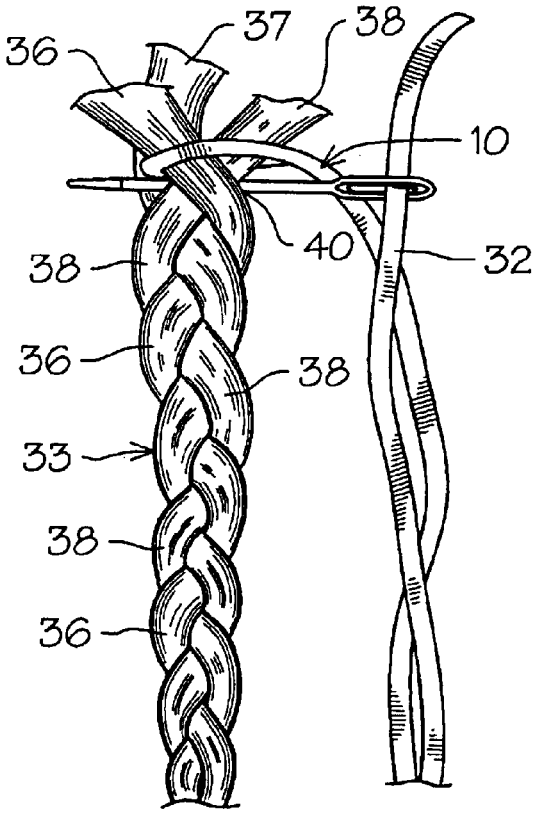
FIG. 8 is a graphic representation of a hair braid illustrating the first insertion point required to form a unique x-ribbon pattern within the braid.

Referring to FIGS. 8 and 9 of the drawings, an alternate hair weaving ribbon pattern is illustrated in which an X-pattern is achieved. In FIG. 8 of the drawings, the steps as illustrated and described hereinbefore for the basic pattern have been used then a first step to inter-weave the X-pattern by inserting the lacing tool 10 under the entire braid 33 from the right side at 40 and bringing it out on the left side in the middle of a braid band. Loop the tool 10 and ribbon up over and across the braid 33 to the right side and then back under the braid 33 to the left. The resulting pattern will define one-half of the respective X-pattern desired. The lacing tool 10 is then removed from the ribbon 32 and re-attached as previously discussed on the remaining ribbon portion and beginning again with the pattern insertion from the top of the hair braid 33 on its right side inserting the tool into insertion points that have the first ribbon inserted and crossing the hair to form an X as seen in FIG. 10 of the drawings.

It will be evident from the above description that a variety of other weaving and patterns can be achieved by utilization of the lacing tool 10 of the invention and that by combining multiple steps and sequential arrangement, the desired decorative effect can be achieved as illustrated, for example, in FIGS. 8 and 10 of the drawings.

It will thus be seen that a new and novel lacing tool method of use has been disclosed herein and that various changes and modifications may be made therein without departing from the spirit of the invention.

Therefore I claim:

1. A hair-lacing tool for inserting a decorative band of material into the human hair comprises, an elongated shaft having a pointed end portion and an oppositely disposed threading portion, said end portion having a conical configuration for insertion through human hair, said threading portion comprising an elongated eyelet having a perimeter support bead extending thereabout, a web of material extending across a portion of said eyelet opening, said web of material is of known length and said eyelet opening is of a length greater than that of said web material, a material engagement notch within said web, said material engagement notch having a tapered end opening of a dimension range from 0.015 to 0.005 of an inch, said notch extending to a transition point in longitudinally spaced relation to said tapered end opening and forms opposing web surfaces wedgeably engage of a ribbon therebetween when transversely inserted and longitudinally disposed within.

2. A method for weaving decorative ribbon into human hair with a hair lacing tool, said tool having an elongated shaft with a pointed hair engagement end and an eyelet opening in oppositely disposed relation thereto, an elongated engagement notch with said eyelet opening, said weaving steps comprises, a. determining length of ribbon to be multiple times the length of a hair braid, b. threading a decorative ribbon through the eyelet opening of the lacing tool wherein said eyelet opening having a web of material extending their across with a tapered opening therein, c. secure ribbon within said opening inwardly of said ribbon's end wherein said webs tapered end opening is of a dimension range from 0.015 to 0.005 of an inch, d. insert said lacing tool under said hair braid, e. pull respective ribbon ends so as to be of equal length on either side of said braid, f. insert lacing tool over top of said hair braid from the oppositely disposed side of said insert, g. push said lacing tool into and out of said hair braid, h. sequentially repeat step of pushing lacing tool in and out of braid in spaced longitudinal insertion points down the length of the hair braid, i. remove said lacing tool from said ribbon, j. thread remaining end of the ribbon through said lacing tool's eyelet opening and retain said ribbon inwardly of its end, k. insert lacing tool over first section of said braid on is opposing side, l. sequentially repeat inserting lacing tool over said first section of braid on its opposite side in spaced longitudinal points along the remaining side of said hair braid.

* * * * *